US008763833B2

(12) United States Patent
Sasaki

(10) Patent No.: US 8,763,833 B2
(45) Date of Patent: Jul. 1, 2014

(54) VACUUM VESSEL, VACUUM PROCESSING APPARATUS COMPRISING VACUUM VESSEL, AND VACUUM VESSEL MANUFACTURING METHOD

(75) Inventor: Masao Sasaki, Hachioji (JP)

(73) Assignee: Canon Anelva Corporation, Kawasaki-Shi, Kanagawa-Ken (JP)

( * ) Notice: Subject to any disclaimer, the term of this patent is extended or adjusted under 35 U.S.C. 154(b) by 1160 days.

(21) Appl. No.: 12/499,926

(22) Filed: Jul. 9, 2009

(65) Prior Publication Data

US 2010/0006470 A1 Jan. 14, 2010

(30) Foreign Application Priority Data

Jul. 14, 2008 (JP) ..... 2008-182470
Jun. 29, 2009 (JP) ..... 2009-153960

(51) Int. Cl.
*B65D 81/20* (2006.01)

(52) U.S. Cl.
USPC ..... 220/4.33

(58) Field of Classification Search
CPC ..... B54D 81/20; B21D 51/24
USPC ..... 206/524.8; 220/4.17, 4.16, 4.28, 4.33, 220/4.31
See application file for complete search history.

(56) References Cited

U.S. PATENT DOCUMENTS 1,307,584 A * 6/1919 Humphryes ..... 220/4.17
1,909,136 A * 5/1933 Thomas, Jr. ..... 220/3.94
2,488,710 A * 11/1949 Cooper ..... 174/372
4,102,557 A * 7/1978 Lee et al. ..... 312/257.1
5,853,176 A 12/1998 Kiriyama
6,415,945 B1 * 7/2002 Zank et al. ..... 220/657
7,267,229 B2 * 9/2007 Chen ..... 206/600
2007/0257033 A1 * 11/2007 Yamada ..... 220/4.33
2009/0255803 A1 10/2009 Nakagawara et al.
2009/0277779 A1 11/2009 Sasaki
2009/0294281 A1 12/2009 Moriwaki et al.

FOREIGN PATENT DOCUMENTS

EP 0452778 A2 10/1991
JP 58-081268 5/1983
JP H04228970 A 8/1992
JP H04236777 A 8/1992
JP 5-103972 A 4/1993
JP 05-263936 A 10/1993
JP 5-326191 A 12/1993
JP 6-029100 A 2/1994

(Continued)

OTHER PUBLICATIONS

Japanese Office Action issued on Dec. 2, 2013, by the Japanese Patent Office in corresponding Japanese Patent Application No. 2009-153960. and an English Translation of the Office Action (7 pages).

*Primary Examiner* — Steven A. Reynolds
*Assistant Examiner* — King M Chu
(74) *Attorney, Agent, or Firm* — Buchanan Ingersoll & Rooney PC

(57) ABSTRACT

A vacuum vessel includes: a pair of bent members formed by bending two metal plates and connected to each other to form a closed space inside; one looped seal member which seals connecting portions of the pair of bent members; a structure arranged in the closed space to abut against an inner surface of the closed space formed by the pair of bent members; and a fastening member which connects the connecting portions of the pair of bent members.

10 Claims, 14 Drawing Sheets

(56) References Cited

FOREIGN PATENT DOCUMENTS

| | | | |
|---|---|---|---|
| JP | 8-064542 | A | 3/1996 |
| JP | 9-209150 | A | 8/1997 |
| JP | 2005163964 | A | 6/2005 |
| JP | 2007-299785 | A | 11/2007 |
| JP | 2008-021487 | A | 1/2008 |

* cited by examiner

VACUUM VESSEL, VACUUM PROCESSING APPARATUS COMPRISING VACUUM VESSEL, AND VACUUM VESSEL MANUFACTURING METHOD

BACKGROUND OF THE INVENTION

1. Field of the Invention

The present invention relates to a vacuum vessel such as a process chamber or transport chamber which forms a vacuum processing apparatus which processes a liquid crystal display substrate, a semiconductor wafer, or the like, a vacuum processing apparatus comprising the vacuum vessel, and a vacuum vessel manufacturing method.

2. Description of the Related Art

Processes of forming a thin film on a liquid crystal display substrate, a semiconductor wafer, or the like and dry etching or heating are mainly performed in a vacuum. Alignment, transport, and the like required to process the substrate or wafer are also often performed in a vacuum continuously. To perform these processes, a vacuum processing apparatus is used in which a plurality of vacuum vessels are connected to each other through gate valves.

Liquid crystal display substrates are becoming larger and larger in recent years, and even a rectangular substrate having a peripheral portion with a side length exceeding 3 m has been introduced. To process such a large-size substrate in a vacuum, a large-size vacuum vessel is required. When a small vacuum vessel is required, a highly hermetic vacuum vessel can be manufactured by hollowing one metal block. When, however, a large-size vacuum vessel is required, a large metal block is difficult to obtain. Therefore, it is difficult to manufacture a large-size vacuum vessel using a method of manufacturing a small-size vacuum vessel.

As shown in FIG. 14, when forming a conventional large-size vacuum vessel, a plurality of metal plate members 101 and 102 are combined and bonded to each other by welding at welding portions 105 to form a frame-like constituent member, so that a mechanical strength is ensured (Japanese Patent Laid-Open No. 8-64542). When a pair of metal plate members 103 are attached to the frame-like constituent member, the air tightness of this large-size vacuum vessel is maintained. As the metal plate members, for example, aluminum or stainless steel plates are used, and their thicknesses may range approximately from 20 mm to as large as 60 mm. This is aimed at supporting the atmospheric pressure acting on the vacuum with the plate members, so the plate members will not deform largely.

When a vacuum vessel is manufactured by a method as in Japanese Patent Laid-Open No. 8-64542, the vacuum vessel becomes heavy. Since this method uses thick, large-size metal plate members, the metal stock as the material is expensive, and such plate members are difficult to obtain.

Problems arising from welding during the manufacture of the vacuum vessel include thermal strain. Hence, secondary cutting is necessary after welding. This increases the number of working steps. A comparatively bulky process machine is also necessary, leading to a high manufacturing cost and a long manufacturing time. In a manufacturing process employing welding, a working defect or the like is difficult to recover. Transportation of a large-size vacuum vessel formed by welding has limitations due to the allowable weight, width, and height of the transportation vehicle and legal restrictions. These limitations sometimes make transportation difficult.

Patent references 2, 3, and the like propose vacuum vessel manufacturing methods that do not use welding. In these manufacturing methods, the shape of a vacuum vessel is formed by combining comparatively thick metal plate members, and a seal member is arranged along the joining portion where the metal plate members are joined to each other.

Methods that do not use a comparatively thick metal plate member are proposed by Japanese Patent Laid-Open Nos. 5-103972, 5-326191, 6-29100, and 2008-21487. The method disclosed in Japanese Patent Laid-Open No. 5-103972 uses a plate member having a honeycomb structure in place of a comparatively thick metal plate member. Japanese Patent Laid-Open Nos. 5-326191, 6-29100, and 2008-21487 disclose a vacuum vessel using a comparatively thin metal plate member.

In the methods disclosed in Japanese Patent Laid-Open Nos. 9-209150 and 2007-299785 which manufacture a vacuum vessel without welding, the structure of the seal member becomes complicated. In Japanese Patent Laid-Open Nos. 9-209150 and 2007-299785, as the comparatively thick metal plates are used in combination, the vacuum vessel becomes heavy and the material cost of the metal plate member increases. It is difficult to obtain the material.

In Japanese Patent Laid-Open Nos. 5-103972, 5-326191, 6-29100, and 2008-21487, to form a closed space by bonding comparatively thin metal plate members, the metal plate members must be welded. Welding may cause thermal strain. Hence, secondary cutting is necessary. This increases the number of working steps. A bulky process machine is also necessary, leading to a high manufacturing cost. In the manufacturing method employing welding, a working defect or the like is difficult to recover. When transporting a large-size vacuum vessel formed by welding, limitations are imposed due to the allowable weight, width, and height of the transportation vehicle and legal restrictions. These limitations sometimes make transportation difficult.

SUMMARY OF THE INVENTION

The present invention provides a vacuum vessel which is lightweight and requires a less manufacturing cost, so that it can be manufactured comparatively easily and handled easily during transportation, a vacuum processing apparatus, and a vacuum vessel manufacturing method.

According to one aspect of the present invention, there is provided a vacuum vessel comprising: a pair of bent members formed by bending two metal plates and connected to each other to form a closed space inside; one looped seal member which seals connecting portions of the pair of bent members; a structure arranged in the closed space to abut against an inner surface of the closed space formed by the pair of bent members; and a fastening member which connects the connecting portions of the pair of bent members.

According to another aspect of the present invention, there is provided a vacuum vessel manufacturing method comprising: a first step of forming a pair of bent members obtained by bending two metal plates and connected to each other to form a closed space inside; a second step of arranging a structure which is to abut against an inner surface of the closed space formed by connecting the bent members, and arranging one looped seal member, which seals connecting portions of the pair of bent members, between inner surfaces of the pair of plate members and an outer surface of the structure throughout the connecting portions; and a third step of connecting the connecting portions of the pair of bent members with a fastening member.

According to the present invention, the vacuum vessel is formed using a pair of bent members formed of comparatively thin metal plate members. Thus, the weight of the vacuum vessel is reduced. As the vacuum vessel can be manufactured without using large-size metal materials, the material cost can be reduced. According to the present invention, the connecting portions of the pair of bent members are sealed with one looped seal member and connected to each other by fastening members. Thus, the manufacturing process of the vacuum vessel does not require welding. Therefore, the vacuum vessel can be manufactured easily, and can be transported in a pre-assembly state, so that it can be handled easily during transportation.

Further features of the present invention will become apparent from the following description of exemplary embodiments with reference to the attached drawings.

DESCRIPTION OF THE EMBODIMENTS

Embodiments of the present invention will now be described with reference to the accompanying drawings.

First Embodiment

Figure 1:
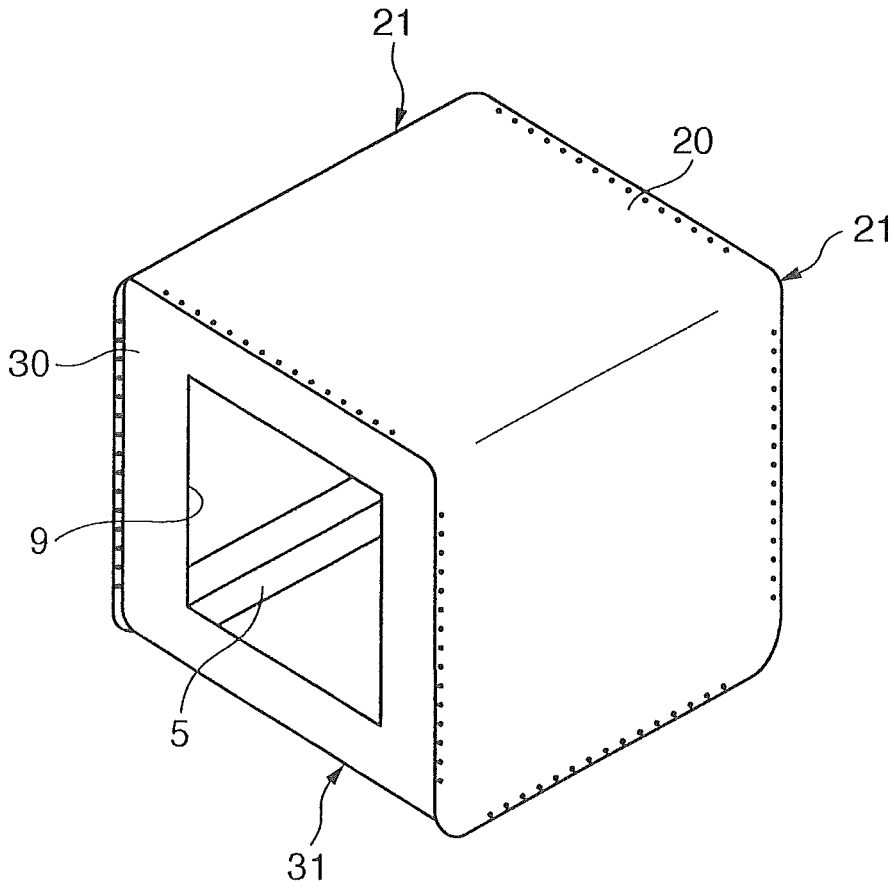
FIG. 1 is a perspective view showing a vacuum vessel according to the first embodiment.
Figure 2:
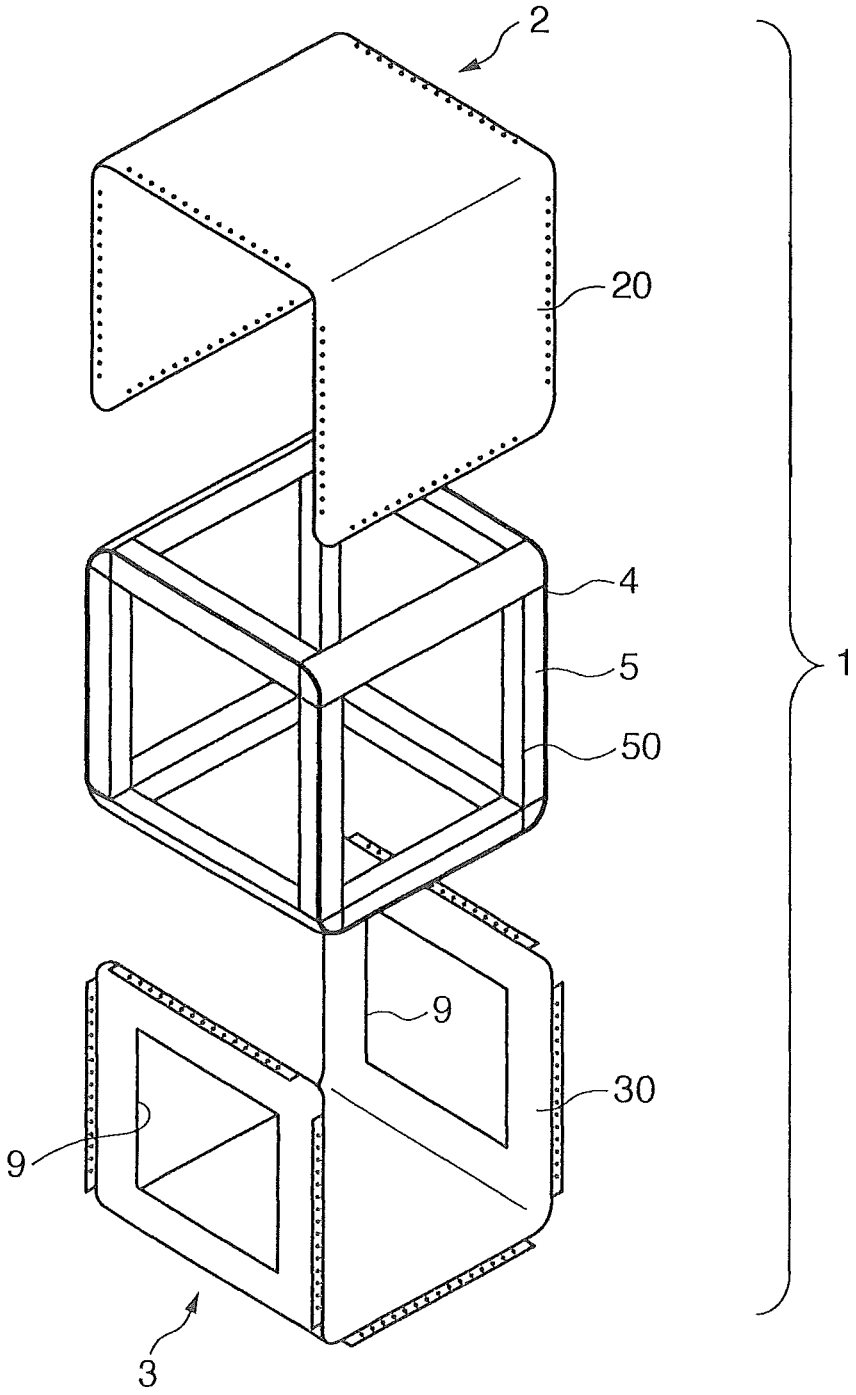
FIG. 2 is an exploded perspective view showing the vacuum vessel.

FIG. 1 shows a vacuum vessel according to the first embodiment. This embodiment shows an example of a hexahedral vacuum vessel. FIG. 2 is an exploded perspective view of the vacuum vessel.

As shown in FIGS. 1 and 2, a vacuum vessel 1 includes a pair of bent members 20 and 30 serving as plate members which are formed by bending metal plates 2 and 3 into predetermined shapes and connected to each other to form a closed space inside. The vacuum vessel 1 also includes a seal member 4 which seals the connecting portions of the pair of bent members 20 and 30, a space lattice structure 5 arranged in the closed space to abut against the inner surfaces of the bent members 20 and 30, and fastening members 6 which connect the connecting portions of the pair of bent members 20 and 30. The connecting portions refer to those portions of the set of bent members 20 and 30 which are close to each other when connecting the bent members 20 and 30 to each other to form the closed space.

The plate members may be made of a material that has at least both a mechanical strength and workability as its quality and can form one closed space when a pair of bent members made of this material are combined.

The bent members 20 and 30 are formed by bending, e.g., one metal plate 2 and one metal plate 3 which are comparatively thin but have desired mechanical strengths. The connecting portions of the bent members 20 and 30 are hermetically sealed by one looped seal member 4. The space surrounded by the two bent members 20 and 30 forms the vacuum vessel 1. The two bent members 20 and 30 and one looped seal member 4 maintain the air tightness of the vacuum vessel 1.

In this embodiment, the vacuum vessel 1 includes the hexahedral structure 5 having desired rigidity. In the structure 5 of this embodiment, portions corresponding to the sides of the respective surfaces of the hexahedron are assembled from 12 columns 50 to form a space lattice. The structure 5 is arranged in the vacuum surrounded by the pair of bent members 20 and 30, and supports the vacuum vessel 1 to further reinforce it against the atmospheric pressure acting on it, thus suppressing deformation of the vacuum vessel 1.

The bent members which form the vacuum vessel 1 will be described hereinafter with reference to FIG. 3, and the structure 5 will be described hereinafter with reference to FIGS. 4 and 5. The seal member 4 will be described with reference to FIG. 6, and the connection structure between the pair of metal plates 2 and 3 will be described with reference to FIG. 7. Finally, members to be attached to the opening of the vacuum vessel 1 will be described with reference to FIG. 8.

First, the bent members which form the vacuum vessel 1 will be described with reference to FIG. 3.

Figure 3:
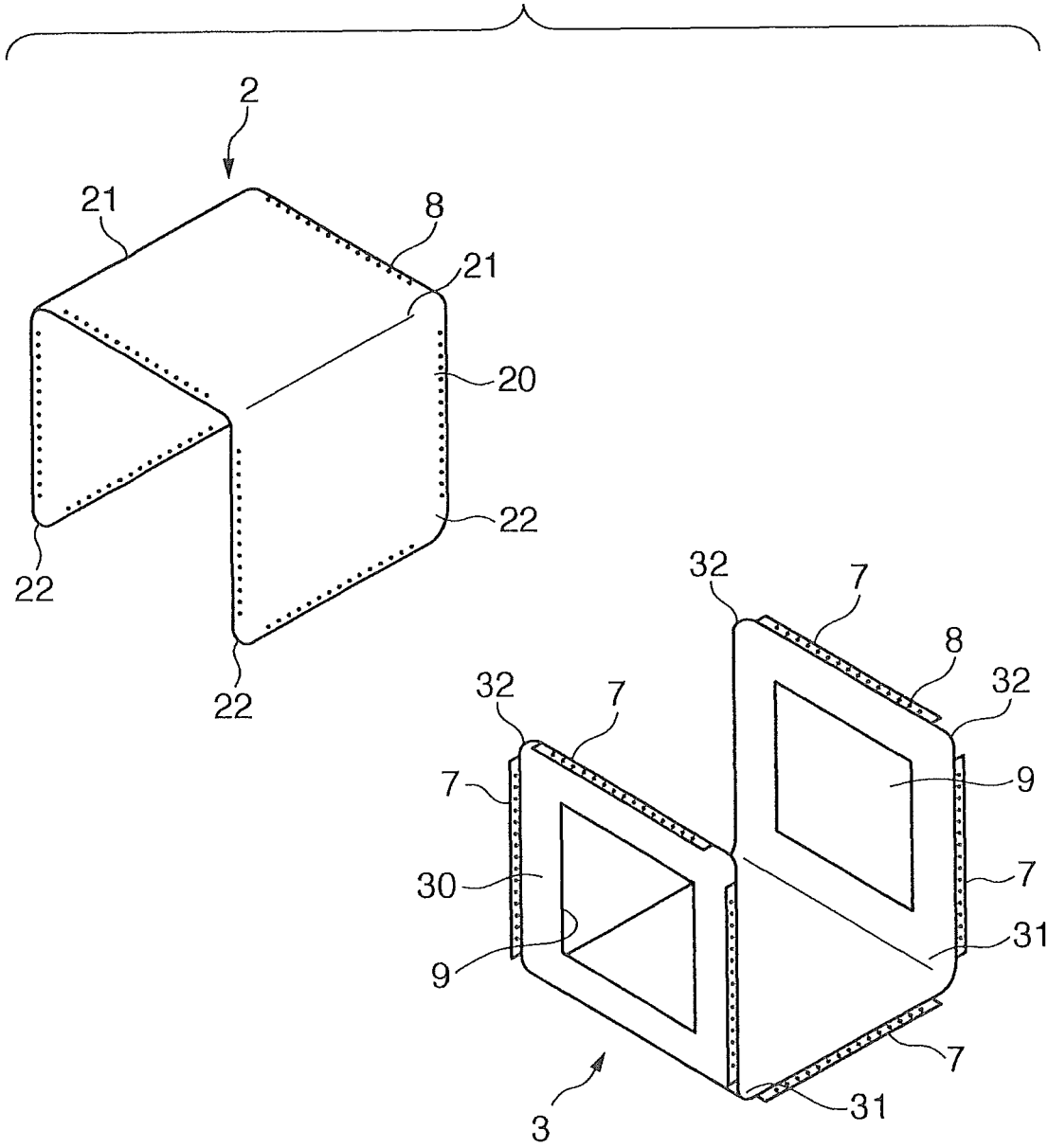
FIG. 3 is a perspective view showing a pair of bent members.

As shown in FIG. 3, for example, two flat plate-like rectangular metal plates 2 and 3 are bent each into a U shape in the longitudinal direction, thus forming the pair of bent members 20 and 30, respectively.

The inner sides of the U shapes of the bent members 20 and 30 are on the vacuum side of the vacuum vessel 1, thus forming the inner surface of the vacuum vessel 1. The bent member 20 has two bent portions 21. Similarly, the bent member 30 has two bent portions 31.

The two bent portions 21 and two bent portions 31 are linear folds formed by bending along straight lines parallel to the short sides. The bent portions 21 and 31 form sides of a polyhedron (solid) which forms the closed space of the vacuum vessel 1.

In this embodiment, since the bent portions 21 and 31 are bent at the right angles, the radius of curvature of bending of each of the bent portions 21 and 31 is approximately 100 mm to 300 mm to form an arcuate section. A small radius of curvature is not preferable because it allows formation of steps on the surfaces of the metal plates 2 and 3 during bending.

As will be described later, the air tightness of the vacuum vessel 1 formed by combining the pair of bent members 20 and 30 is maintained by the surface states of the bent members 20 and 30 which form the vacuum vessel 1, and the seal member 4 (see FIG. 2) such as an O-ring.

For this purpose, the surfaces of the bent members 20 and 30 at portions where the bent members 20 and 30 come into contact with the seal member 4 must be smooth. The larger the radius of curvature of bending of each of the bent portions 21 and 31, the more the steps are suppressed from being formed on the surfaces of the bent members 20 and 30. Then, the bent members 20 and 30 are in good contact with the seal member 4.

The bent member 20 has corners 22 to be combined with the bent member 30 and located at the corners at the two ends in the longitudinal direction. Each corner 22 has a radius of curvature of approximately 100 mm to 300 mm and is formed by cutting into an arc. Then, when the bent member 20 is connected to the bent member 30, the bent member 20 conforms to the radii of curvature of bending of the bent portions 31 of the bent member 30.

Of the peripheral portion of the bent member 30 formed by bending the metal plate, the non-bent straight portions respectively have connecting bent portions 7 bent toward the outer side of the vacuum vessel 1 so as to be perpendicular to the outer surface of the vacuum vessel 1. Each connecting bent portion 7 is formed to have a width of approximately 10 mm to 50 mm in a direction to project outside the vacuum vessel 1, and has a plurality of connection holes 8 which are almost equidistant along the straight portions. The connection holes 8 serve as holes through which, for example, fastening bolts or screws as fastening members are to be inserted. As the connecting bent portions 7 are used only to connect the bent member 20 to the bent member 30 with the fastening bolts, their radii of curvature of bending may be comparatively as small as several mm.

The vacuum vessel 1 usually has an opening 9 through which a substrate is to be transported into the vacuum vessel 1, or to which various types of devices are to be connected. In this embodiment, two opposing flat surfaces of the bent member 30 respectively have rectangular openings 9. Another vacuum vessel, device, or lid is to be connected to each opening 9, so that the air tightness in the vacuum vessel 1 is finally maintained. The openings 9 will be described later in detail.

Similarly to the bent member 30, the bent member 20 is formed by bending a flat plate-like rectangular thin metal plate into a U shape. The respective sides of the bent member 20 are slightly longer than the corresponding sides of the bent member 30, so the straight portions of the bent member 20 which are not provided with connecting bent portions corresponding to the connecting bent portions 7 of the bent member 30 overlap the connecting bent portions 7 of the bent member 30 well. The bent members 20 and 30 are bent along the folds that form the sides of the polyhedron which forms the closed space, thus forming the bent portions 21 and 31.

The radii of curvature (the radii of curvature of the inner surface side) of the bent portions 21 as the linear folds formed at the two portions of the bent member 20 are equal to the radii of curvature of corresponding corners 32 of the bent member 30. The radii of curvature of the corners 22 are slightly larger than those of the corresponding bent portions 31 of the bent member 30, so the connecting bent portions 7 of the bent member 30 overlap the straight portions of the bent member 20 well.

As the material of the bent members 20 and 30, a metal material such as aluminum or stainless steel is used. The bent members 20 and 30 preferably have thicknesses of approximately 0.1 mm to 3 mm. When the bent member has a thickness falling within this range, it can be bent easily, and the bent portion can be formed to have a smooth surface. If the bent member is excessively thick, upon bending, steps may be formed on the surface of the bent portion. This makes it difficult to seal the interior of the vacuum vessel 1. If the bent member is excessively thin, upon vacuum evacuation of the interior of the vacuum vessel 1, the bent member may deform, or a seal member such as an O-ring cannot be squeezed reliably, making it difficult to seal the interior of the vacuum vessel.

Figure 4:
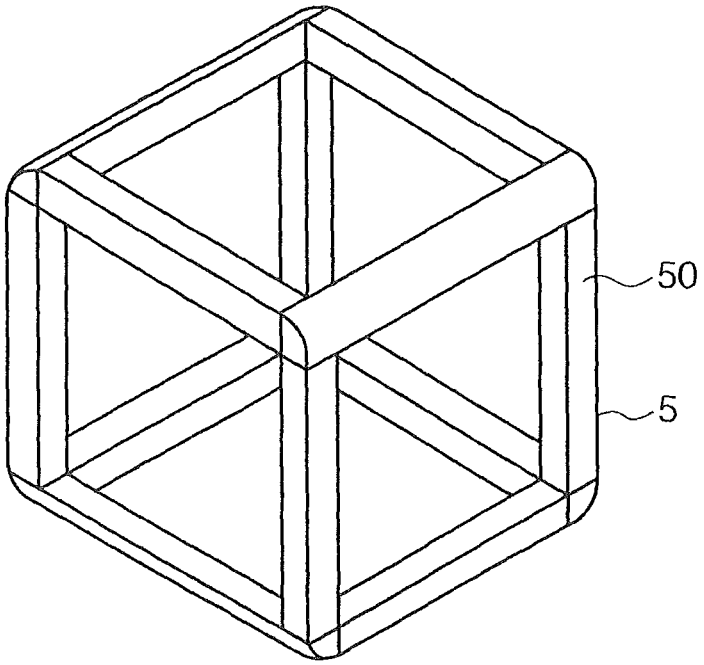
FIG. 4 is a perspective view showing a structure.

FIG. 4 shows an arrangement of the structure 5.

In this embodiment, the structure 5 includes the 12 columns 50 located at positions corresponding to the sides of the respective surfaces of the hexahedron. The columns 50 are made of a rigid metal material such as stainless steel or aluminum. The respective columns 50 are fixed by fastening bolts (not shown) and assembled together to have a mechanical strength that can support the vacuum vessel against the atmospheric pressure acting on the vacuum vessel. Since all the columns 50 are arranged inside the vacuum vessel, they need no device to maintain the air tightness. Accordingly, in the structure 5, the columns 50 need not be welded, or need no seal surfaces.

The outer shape of the structure 5 is formed to correspond to the inner shape of the vacuum vessel 1 which is formed by combining the two bent members 20 and 30. Of the 12 sides of the hexahedron which forms the structure 5, four sides form curved surfaces coinciding with the inner shape of the vacuum vessel 1. Namely, the corners of the structure 5 corresponding to the respective bent portions 21 and 31 of the bent members 20 and 30 may deform as the curved surfaces corresponding to the bent portions 21 and 31 are formed there. If the deformation occurring in the vacuum vessel 1 enlarges, the air tightness of the closed space cannot be maintained, or the vacuum vessel 1 may be broken.

Figure 5:
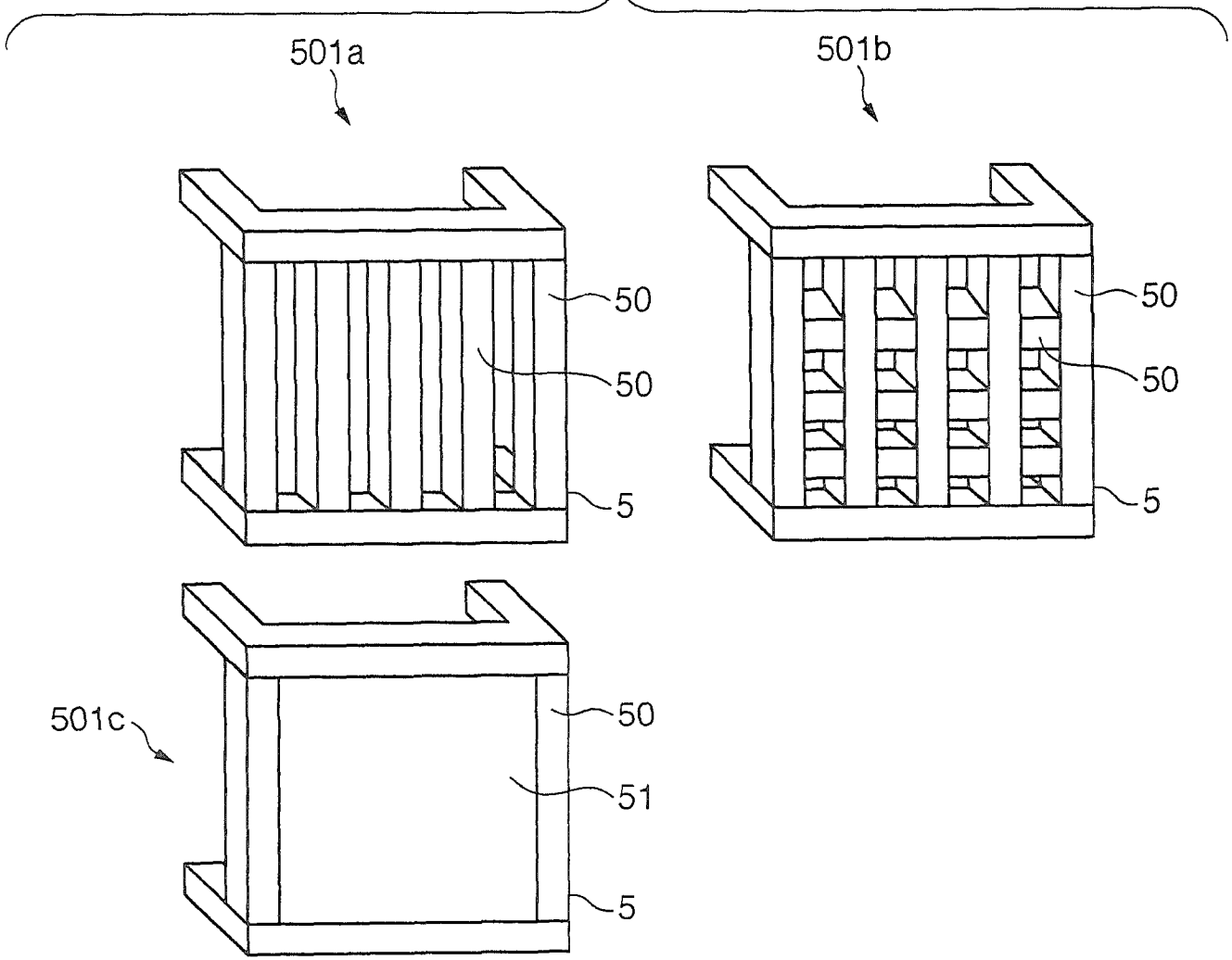
FIG. 5 is a perspective view showing other examples of the structure.

In view of this, in order to further suppress the deformation of the bent members 20 and 30 which form the inner wall of the vacuum vessel 1, preferably, the columns 50 which form the structure 5 may be arranged to form a fence as shown by 501*a* in FIG. 5, or a lattice as shown by 501*b* in FIG. 5. If at least one surface surrounded by the columns 50 is covered with a flat plate member 51, as shown by 501*c* in FIG. 5, the deformation of the inner wall of the vacuum vessel 1 can be suppressed to be very small.

When, however, the number of columns 50 is increased or the surface surrounded by the columns 50 is covered with the flat plate member 51, the vacuum vessel 1 becomes heavy, and the manufacturing cost increases. For this reason, desirably, the number of columns 50 that form the structure 5 is minimized within a range where the deformation of the vacuum vessel 1 is allowable.

Figure 6:
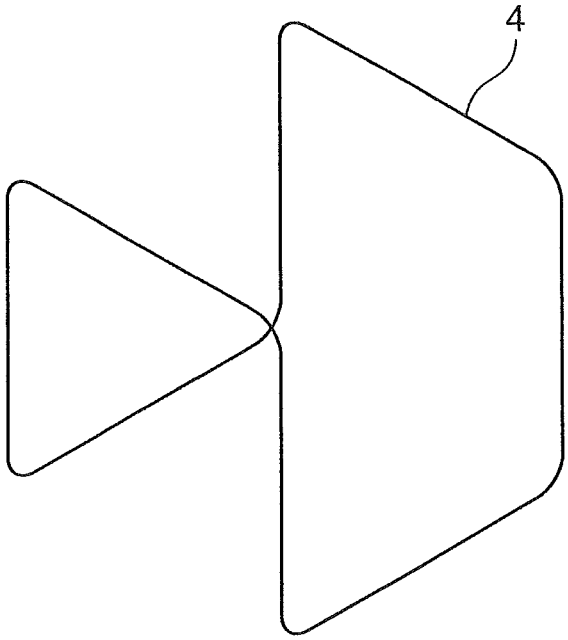
FIG. 6 is a perspective view showing a seal member.

FIG. 6 is a perspective view of an O-ring as an example of the seal member 4. The seal member 4 is an O-ring made of a rubber material. As the seal member 4, one having an annular shape with a circular section is used. As shown in FIG. 6, the seal member 4 is formed into the same shape as that formed by the connecting portions of the two bent members 20 and 30, and seals the entire connecting portions of the two bent members 20 and 30.

Figure 7:
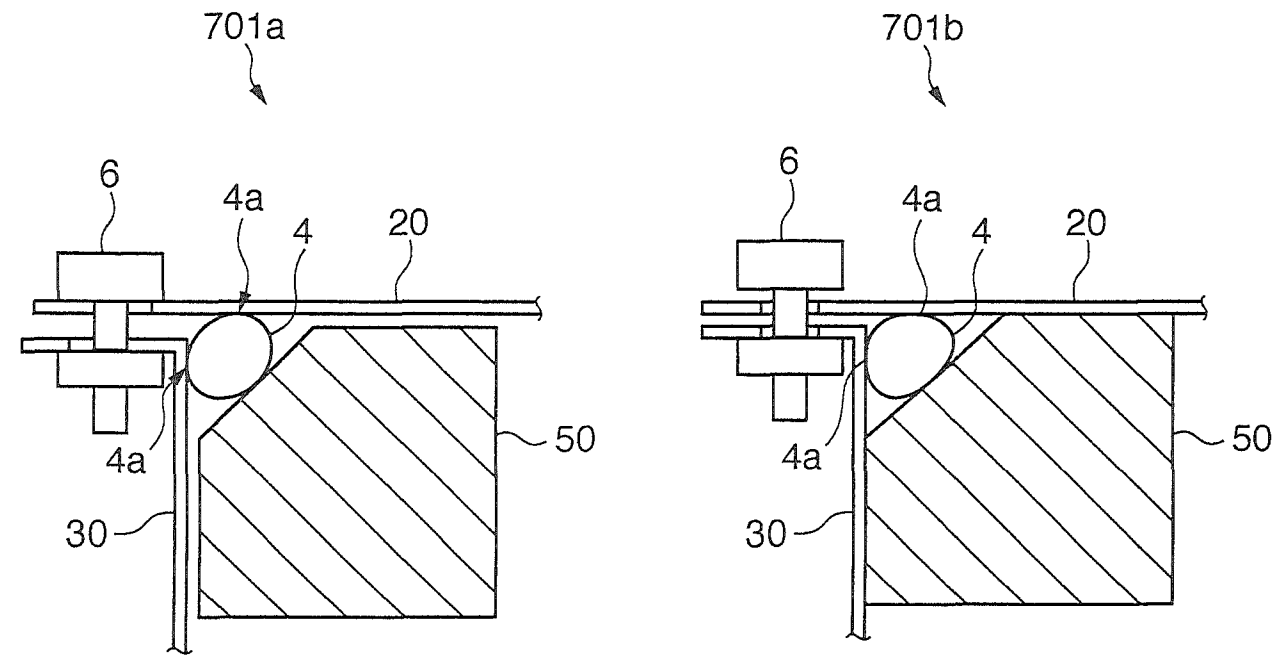
FIG. 7 is a sectional view to explain a sealing state of the seal member.

FIG. 7 includes in 701*a* and 701*b* sectional views to explain the connected state of the pair of bent members 20 and 30 of this embodiment.

The sectional view of 701*a* in FIG. 7 shows a state before the interior of the vacuum vessel 1 is evacuated to a vacuum. As shown by 701*a* in FIG. 7, the seal member 4 is sandwiched by three surfaces, that is, the side surface of the column 50 and the bent members 20 and 30. The column 50 is formed such that its surface that abuts against the seal member 4 forms angles of 45° with respect to the inner wall of the vacuum vessel 1, that is, the inner surfaces of the bent members 20 and 30. In this embodiment, the sectional shape formed by the three surfaces surrounding the seal member 4 is a rectangular equilateral triangle.

The bent members 20 and 30 are fixed to each other by a comparatively small fastening force using the fastening members 6 such as fastening bolts. According to the arrangement of this embodiment, the fastening members 6 need only be fastened by a force sufficient to deform the seal member 4 slightly. The function of the fastening members 6 is to enable rough evacuation without forming a comparatively large gap in seal portions 4*a* when the vacuum vessel 1 is to be evacuated by a vacuum pump (not shown). When the fastening members 6 are tightly fastened, the thin-walled bent members 20 and 30 deform near the seal portions 4*a*, as they are not rigid enough to squeeze the seal member 4 completely, and gaps are formed in the seal portions 4*a*. This is not preferable. Before evacuation, rough evacuation by the vacuum pump is possible as far as no comparatively large gaps are formed in the seal portions 4*a*. Thus, the fastening members 6 need only be fixed with a comparatively small fastening force.

The seal portions 4*a* are a portion where the seal member 4 is in contact with the bent member 20 and a portion where the seal member 4 is in contact with the bent member 30, respectively. The seal portion 4*a* is not located at the position between the seal member 4 and column 50, and the column 50 has only the function of supporting the seal member 4.

As shown by 701*a* in FIG. 7, before evacuating the vacuum vessel 1, the two bent members 20 and 30 do not squeeze the seal member 4, and accordingly do not abut against the column 50.

701*b* in FIG. 7 shows a state after the vacuum vessel 1 is evacuated to a vacuum. The inner wall of the vacuum vessel 1 defined by the two bent members 20 and 30 receives from the atmospheric pressure a pressing force toward the vacuum side and shifts until it abuts against the side surface of the column 50. This squeezes the seal member 4 appropriately, thus exhibiting a good seal performance.

At this time, the seal portions 4*a* formed by the seal member 4 exist between the seal member 4 and bent member 20 and between the seal member 4 and bent member 30, respectively. The seal portions 4*a* seal the connecting portions of the vacuum vessel 1 throughout the entire regions, thus maintaining good air tightness in the interior of the vacuum vessel 1. At this time, as the bent members 20 and 30 squeeze the seal member 4, the force of the atmospheric pressure acting on the bent members 20 and 30 covers as far as near the seal portions 4*a*. Even if the bent members 20 and 30 are thin-walled and less rigid, they can squeeze the seal member 4 without deformation.

In this case as well, the column 50 serves to support the seal member 4 in the vacuum.

As described above, the vacuum vessel manufacturing method of this embodiment includes a step of arranging the structure 5 and arranging the seal member 4 between the inner surfaces of the bent members 20 and 30 and the outer surface of the structure 5 throughout the connecting portions, and a step of connecting the bent members 20 and 30 with the fastening members 6.

The structure of the opening 9 of the vacuum vessel 1 of this embodiment will now be described with reference to FIG. 8.

A comparatively heavy object is often attached to the opening 9 of the vacuum vessel 1. A component to be attached to the opening 9 is usually a structure called a vacuum flange. To attach the vacuum flange to the vacuum vessel 1, the vacuum vessel 1 must be provided with a seal surface and bolt holes.

In this embodiment, considering the mechanical strength of the bent members 20 and 30 which form the vacuum vessel 1, a heavy object cannot be directly attached to the bent members 20 and 30. As the bent members 20 and 30 are comparatively thin, it is difficult to form the bolt holes directly in the bent members 20 and 30 without penetrating them.

Figure 8:
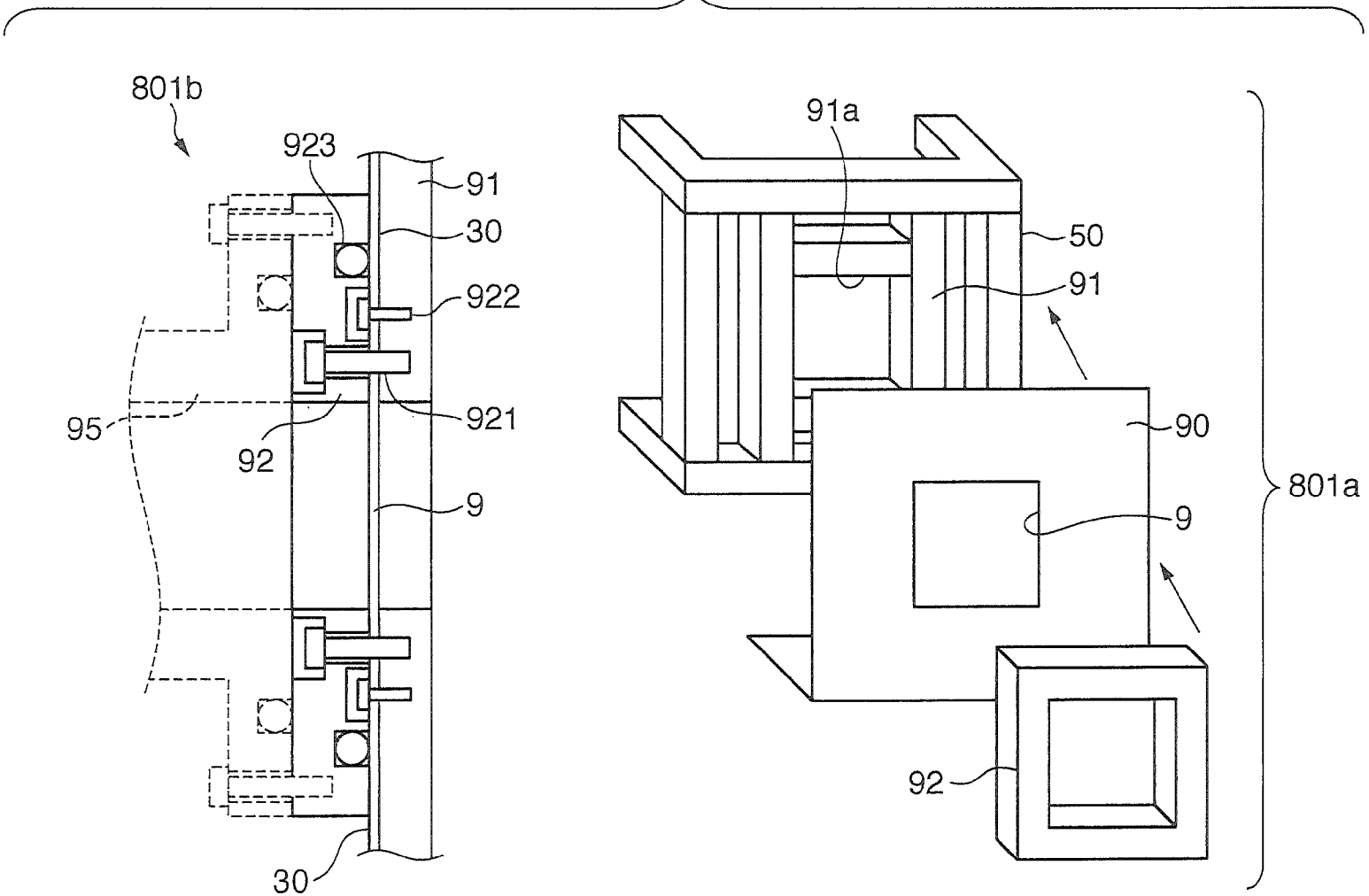
FIG. 8 is a view to explain an opening flange.

In view of this, as shown in 801*a* in FIG. 8, at the opening 9 of an opening plate body 90, an opening column 91 must be arranged on the vacuum side, that is, on the inner surface of the vacuum vessel 1, and an integral opening flange 92 must be arranged on the atmosphere side, that is, on the outer surface of the vacuum vessel 1.

The opening column 91 forms a rigid structure provided with an opening 91*a* slightly smaller than the opening 9 of the opening plate body 90. The opening column 91 is arranged at a position for abutting against the opening plate body 90 from the vacuum side. As the opening column 91 supports the weight of the opening flange 92 and that of the attached vacuum flange and receives other forces, it is formed to have sufficient rigidity so it will not deform. As the opening column 91 is a structural member arranged in the vacuum, it need not be provided with a seal surface, and need not be formed into an integral structure by welding.

801*b* in FIG. 8 includes a sectional view of the opening of the vacuum vessel 1 to which the opening column 91 and opening flange 92 are attached.

The bent member 30 is fixed to the opening column 91 in the vacuum with opening plate body fixing bolts 922. This fixing structure is to position the opening 9 with respect to the opening column 91, and is not always necessary.

The opening flange 92 is fixed to the opening column 91 with opening flange fixing bolts 921 in order to ensure the mechanical strength. An O-ring 923 arranged between the bent member 30 and opening flange 92 outside the opening flange fixing bolts 921 maintains the air tightness between the opening flange 92 and bent member 30.

Hence, the opening flange 92 must be a seamless member fabricated as an integral structure from one metal plate by shaving or the like. The opening flange 92 is provided with blind bolt holes on the atmosphere side so it serves as an ordinary vacuum flange. An external flange 95 can be attached to the opening flange 92 by an ordinary method.

As described above, with the vacuum vessel 1 of this embodiment, since the vacuum vessel 1 is formed of the pair of bent members 20 and 30 which are comparatively thin metal plates, the weight of the vacuum vessel is reduced. Thus, the vacuum vessel can be manufactured without using a large-size metal stock unlike in the conventional case. Hence, according to this embodiment, the material cost of the vacuum vessel can be reduced. According to this embodiment, since the connecting portions of the pair of bent members 20 and 30 are sealed by one looped seal member 4 and connected by the fastening members 6, welding is not necessary in the vacuum vessel manufacturing process. Thus, the vacuum vessel 1 can be manufactured easily, and transported in a pre-assembly state. This facilitates handling of the vacuum vessel during transportation.

Second Embodiment

A vacuum vessel according to the second embodiment will be described hereinafter with reference to FIGS. 9 and 10.

Figure 9:
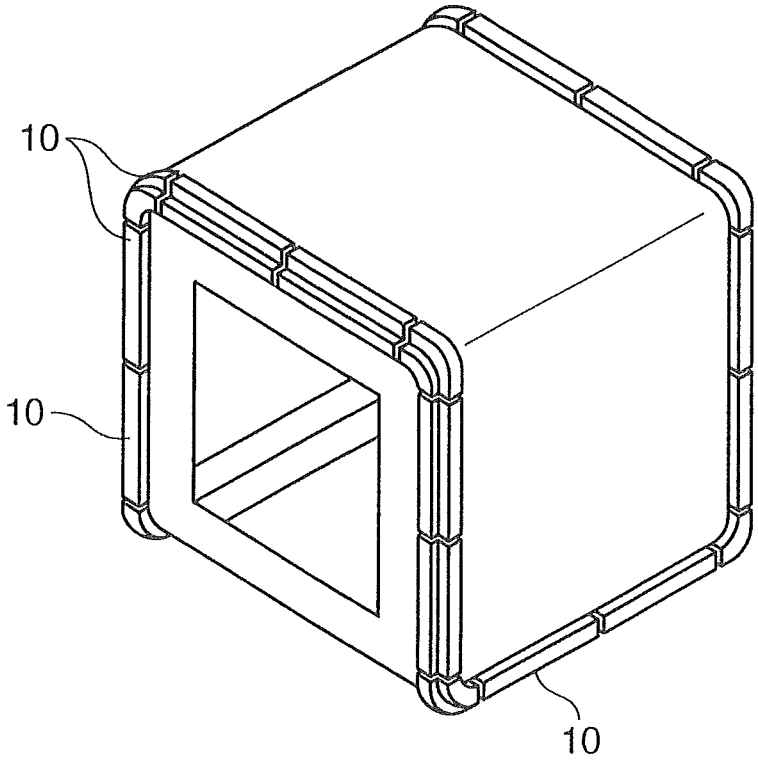
FIG. 9 is a perspective view showing a vacuum vessel according to the second embodiment.

FIG. 9 is a perspective view of the vacuum vessel according to the second embodiment. FIG. 10 is a sectional view of the seal portion of the vacuum vessel according to the second embodiment.

Figure 10:
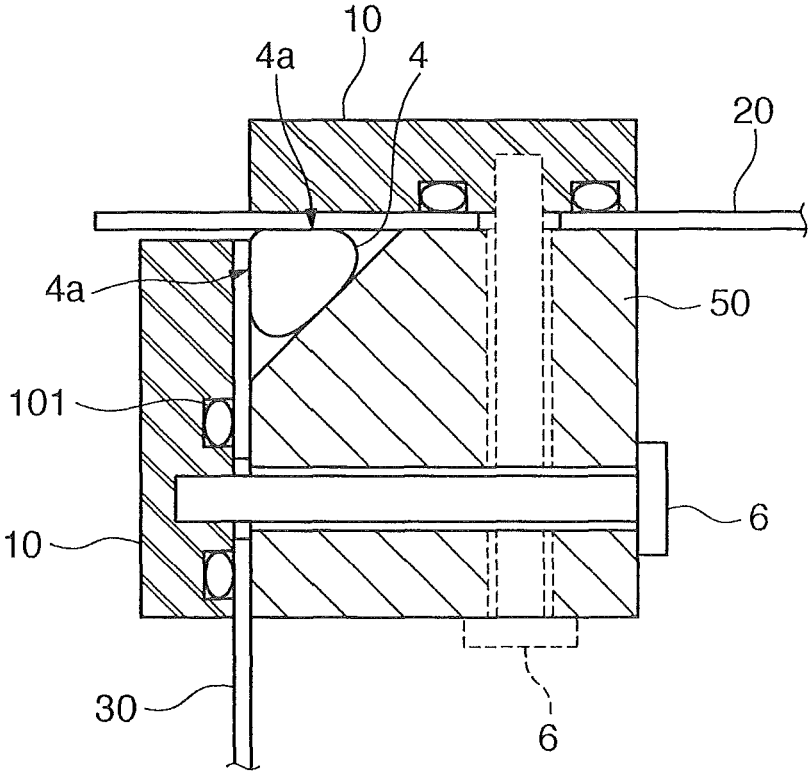
FIG. 10 is a sectional view showing the seal portion of the vacuum vessel according to the second embodiment.

As shown in FIGS. 9 and 10, in this embodiment, a seal member 4 such as an O-ring which seals the connecting portions of bent members 20 and 30 is forcedly squeezed before vacuum evacuation of a vacuum vessel 1, so that good seal portions 4*a* are formed. In FIG. 10, connecting bent portions corresponding to the connecting bent portions 7 of the bent member 30 shown in FIG. 3 are eliminated. Connection holes 8 of the bent members 20 and 30 are arranged almost equidistantly in the peripheral portion along the entire straight portions and curved portions.

As shown in FIG. 9, a plurality of seal portion fixing plates 10 serving as seal portion pressing members which press the seal member 4 are arranged in the peripheral portion of the atmosphere-side surface of each of the bent members 20 and 30 throughout the entire connecting portions. As shown in FIG. 10, the seal portion fixing plates 10 are arranged at portions where the bent members 20 and 30 abut against the seal member 4 and columns 50 which support the seal member 4 when the vacuum vessel 1 is evacuated to a vacuum. Also, arcuate seal portion fixing plates 10 are arranged at bent portions (the bent portions 21 and 31 shown in FIG. 3) of metal plates 2 and 3.

The seal portion fixing plates 10 are made of metal plates thicker than the bent members 20 and 30 to have desired rigidity. The seal portion fixing plates 10 sandwich the bent members 20 and 30 and are fixed to the corresponding column 50 by fastening members 6. The seal portion fixing plates 10 urge the bent members 20 and 30 against the column 50 and squeeze the seal member 4, so that the seal portions 4*a* maintain good air tightness.

The fastening members 6 are inserted in the seal portion fixing plates 10 from the vacuum side of the vacuum vessel 1, that is, from the inner surface sides of the bent members 20 and 30 through the connection holes 8 of the bent members 20 and 30. Therefore, the fastening members 6 and their vicinities must be sealed. For this purpose, small O-rings 101 are arranged, around the fastening members 6, between the seal portion fixing plates 10 and bent member 20, and between the seal portion fixing plates 10 and bent member 30.

With the above arrangement, according to the second embodiment, the air tightness of the vacuum vessel 1 can be maintained easily and reliably.

Third Embodiment

A vacuum vessel according to the third embodiment will be described with reference to FIG. 11.

Figure 11:
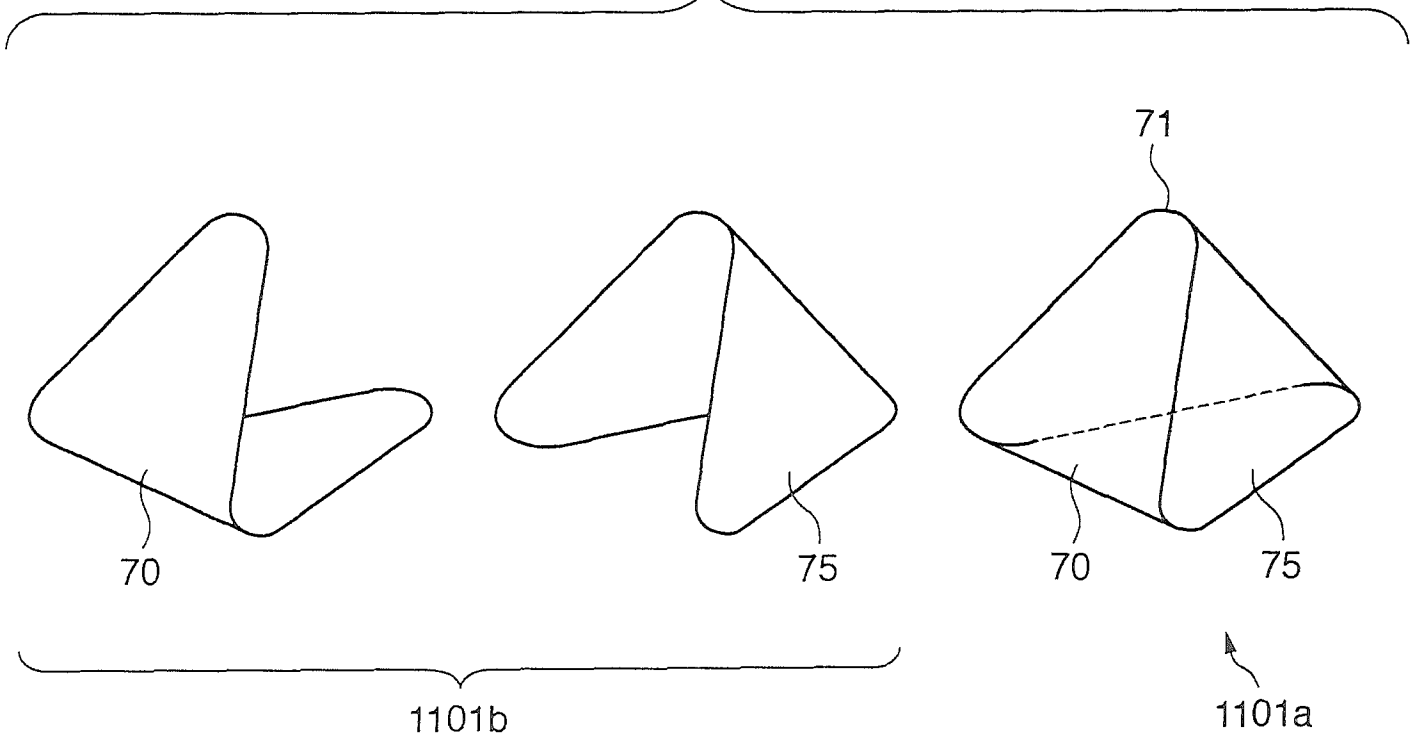
FIG. 11 is a perspective view showing a vacuum vessel according to the third embodiment as another arrangement.

As shown in 1101*a* and 1101*b* in FIG. 11, a vacuum vessel 71 of this embodiment is formed by connecting a pair of bent members 70 and 75. Each of the bent members 70 and 75 is formed by bending an almost rhombic metal plate along one diagonal of the rhombus. The pair of bent members 70 and 75 are sealed at their connecting portions with a seal member (not shown), thus forming the vacuum vessel 71. A structure (not shown) is arranged in the vacuum vessel 71. To connect the bent members 70 and 75, the connection structure described above is employed.

According to this embodiment, the tetrahedral vacuum vessel 71 can be formed by combining the bent members 70 and 75.

Fourth Embodiment

A vacuum vessel according to the fourth embodiment will be described with reference to FIG. 12.

Figure 12:
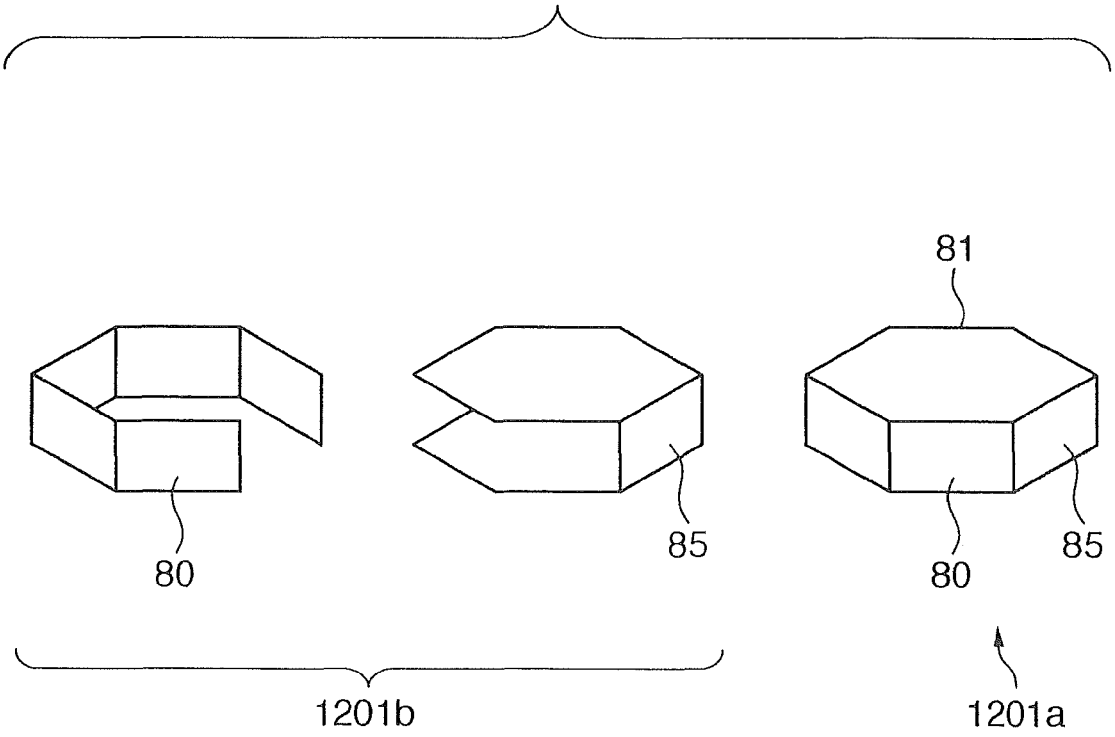
FIG. 12 is a perspective view showing a vacuum vessel according to the fourth embodiment as another arrangement.

As shown in 1201*a* and 1201*b* in FIG. 12, a vacuum vessel 81 of the fourth embodiment is formed by connecting a pair of bent members 80 and 85. One bent member 80 is formed by bending one rectangular metal plate at four portions. The other bent member 85 is obtained by forming a shape having three surfaces, that is, a hexagon, a rectangle, and a hexagon, from one metal plate and bending this shape at two portions. The pair of bent members 80 and 85 are sealed at their connecting portions with a seal member (not shown). A structure (not shown) is arranged in the vacuum vessel 81.

According to this embodiment, the octahedral vacuum vessel 81 can be formed by combining the bent members 80 and 85.

Figure 13:
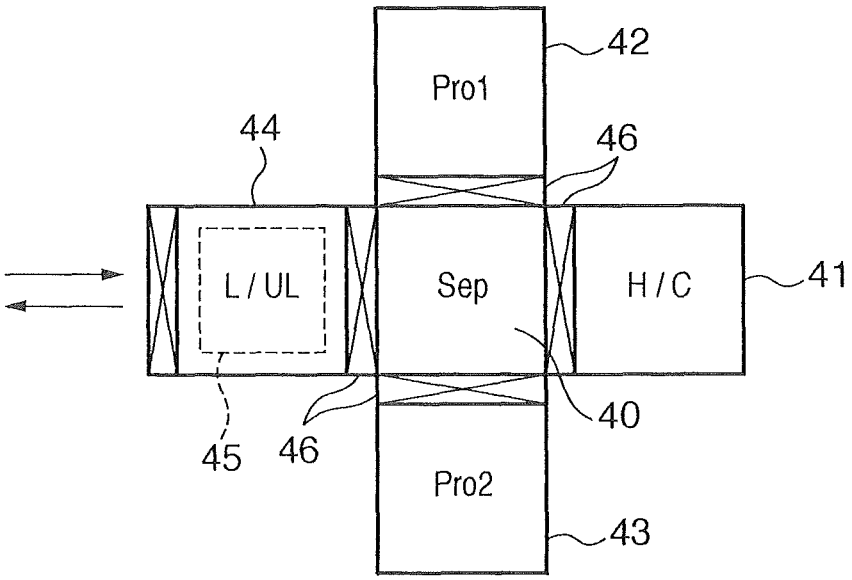
FIG. 13 is a schematic view showing a vacuum processing apparatus.
Figure 14:
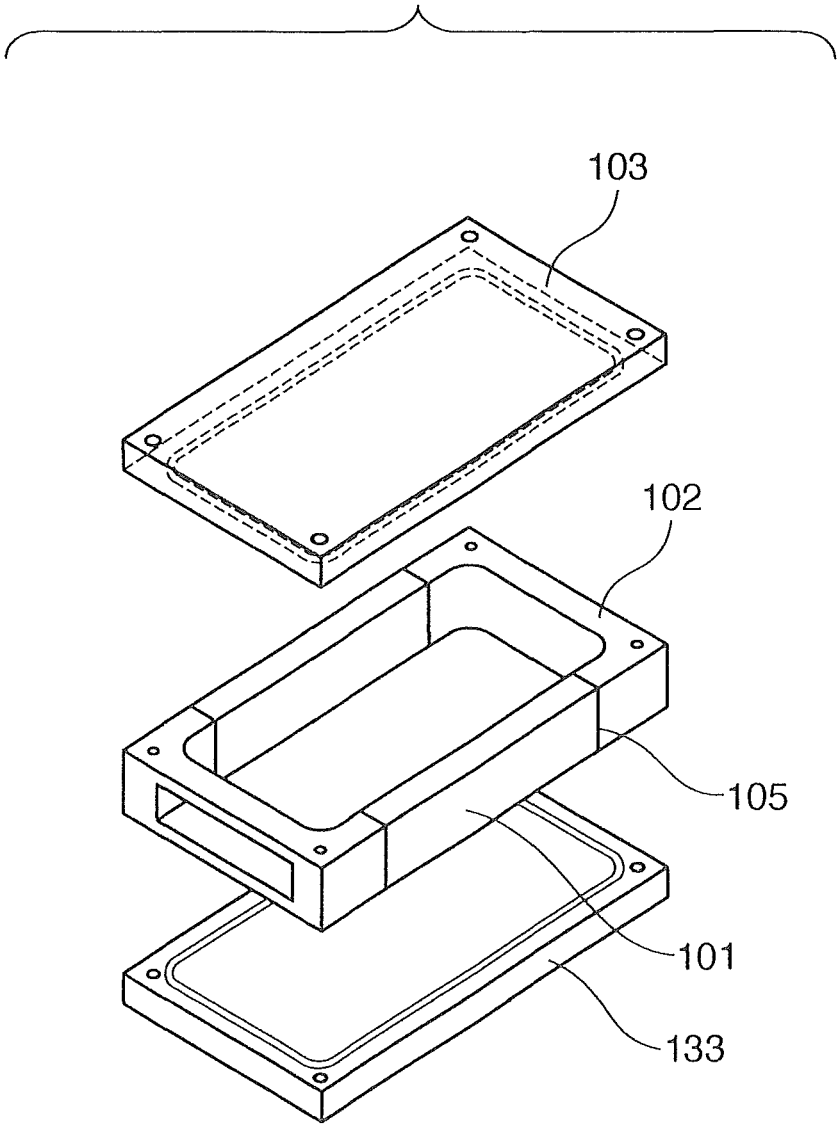
FIG. 14 is an exploded perspective view showing a conventional vacuum vessel.

FIG. 13 shows an example of a vacuum processing apparatus comprising the vacuum vessel of the fourth embodiment.

As shown in FIG. 13, the vacuum processing apparatus is, for example, a single wafer type vacuum processing apparatus, and includes a first sputtering vacuum processing chamber (Pro1) 42 and second sputtering vacuum processing chamber (Pro2) 43. This vacuum processing apparatus also includes a separation chamber (Sep) 40 including a transport mechanism, and a heating/cooling chamber (H/C) 41. The chambers 40, 41, 42, and 43 respectively have vacuum vessels of the fourth embodiment. The chambers 41, 42, and 43 are arranged adjacent to the separation chamber 40.

The vacuum processing apparatus is provided with gate valves 46 between a loading chamber (L) 44 and the separation chamber 40, between the separation chamber 40 and heating/cooling chamber 41, between the vacuum processing chamber 42 and separation chamber 40, and between the vacuum processing chamber 43 and separation chamber 40. The vacuum processing apparatus is partitioned by the gate valves 46 so that a substrate 45 as a target object which is to be processed in a vacuum under a reduced pressure can be loaded and unloaded. The respective chambers of the vacuum processing apparatus can be maintained at a vacuum independently of each other.

After the loading chamber 44 is vacuum-evacuated to a predetermined pressure by an exhaust system (not shown), the substrate 45 transported there is transported to the separation chamber 40. Subsequently, the substrate 45 is sent from the separation chamber 40 to the heating/cooling chamber 41 or the vacuum processing chamber 42 or 43 in accordance with the required process among various types of processes. After the vacuum process, the substrate 45 is unloaded from the unloading (UL) chamber 44 through the separation chamber 40.

Although the vacuum processing apparatus is exemplified by a sputtering deposition apparatus in this embodiment, the deposition apparatus is not limited to one employing sputtering. This embodiment can also employ a deposition apparatus using a deposition method such as chemical vapor deposition, and can also be applied to a processing apparatus such as an etching apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-182470, filed Jul. 14, 2008, Japanese Patent Application No. 2009-153960, filed Jun. 29, 2009, which are hereby incorporated by reference herein in their entirety.

What is claimed is:

1. A vacuum vessel comprising:

a pair of bent members formed by bending two metal plates and connected to each other to form a closed space inside the vacuum vessel;

a seal member which seals connecting portions of said pair of bent members and is configured as one looped seal member;

a structure arranged in the closed space to abut against an inner surface of the closed space formed by said pair of bent members; and a fastening member which connects the connecting portions of said pair of bent members, wherein the seal member is formed along a bend of each of the pair of bent members for providing a vacuum seal, the seal member is pressed to said structure and said pair of bent members in accordance with a fastening force provided by said fastening member, and the connecting portions are sealed by the pressed seal member;

wherein one bent member of said pair of bent members has connecting bent portions bent toward an outer side of the vacuum vessel so as to be perpendicular to an outer surface of the vacuum vessel, and the connecting bent portions are used to connect said pair of bent members via said fastening member.

2. The vessel according to claim 1, wherein the closed space has a shape of a polyhedron, and said bent members are bent along folds that form sides of the polyhedron.

3. The vessel according to claim 1, wherein said seal member is sandwiched by surfaces of said pair of bent members and said structure.

4. The vessel according to claim 1, wherein said pair of bent members are fixed at peripheral portions thereof with bolts.

5. The vessel according to claim 1, wherein said pair of bent members are provided with seal portion pressing members, respectively, which press said seal member at peripheral portions thereof along the connecting portions.

6. A vacuum processing apparatus comprising a vacuum vessel according to claim 1, wherein a target object undergoes a process in said vacuum vessel under a reduced pressure.

7. The apparatus according to claim 6, wherein at least one of said pair of bent members includes an opening.

8. The apparatus according to claim 7, wherein a structural object is fixed to surround the opening.

9. A vacuum vessel manufacturing method comprising:

forming a pair of bent members obtained by bending two metal plates and connected to each other to form a closed space inside said vacuum;

arranging a structure which is to abut against an inner surface of the closed space formed by connecting the bent members, and arranging one looped seal member, which seals connecting portions of the pair of bent members, between inner surfaces of the pair of bent members and an outer surface of the structure throughout the connecting portions; and connecting the connecting portions of the pair of bent members with a fastening member, wherein the seal member is formed along a bend of each of the pair of bent members for providing a vacuum seal, pressing the seal member to said structure and said pair of bent members in accordance with a fastening force provided by said fastening member, and sealing the connecting portions by the pressed seal member;

wherein one bent member of said pair of bent members has connecting bent portions bent toward an outer side of the vacuum vessel so as to be perpendicular to an outer surface of the vacuum vessel, and using the connecting bent portions to connect said pair of bent members via said fastening member.

10. The apparatus according to claim 1, wherein said seal member has a three dimensional bending shape so as to be formed along the bends of the pair of bent members.

* * * * *